United States Patent [19]

McVay et al.

[11] Patent Number: 4,981,274

[45] Date of Patent: Jan. 1, 1991

[54] METHOD AND APPARATUS FOR BAGGING TRASH

[75] Inventors: Roger S. McVay, Satsuma; W. E. Brooklyn, Eight Mile; Charles E. Bell, Satsuma, all of Ala.

[73] Assignee: George L. Williamson, Daphne, Ala.

[21] Appl. No.: 434,181

[22] Filed: Nov. 13, 1989

[51] Int. Cl.[5] ..... B65B 67/04

[52] U.S. Cl. ..... 248/99; 248/97

[58] Field of Search ..... 248/100, 95, 97, 99, 248/101; 220/404; 141/314, 391

[56] References Cited

U.S. PATENT DOCUMENTS

| | | | |
|---|---|---|---|
| 447,686 | 3/1891 | Holladay | 248/100 X |
| 2,100,235 | 11/1937 | Brown | 248/100 X |
| 3,502,291 | 3/1970 | Ackerman et al. | 248/101 X |
| 3,655,157 | 4/1972 | Dalton | 248/97 |
| 3,695,565 | 10/1972 | Hodges | 248/97 |
| 4,692,050 | 9/1989 | Kaufman | 248/97 X |

*Primary Examiner*—Ramon O. Ramirez

*Attorney, Agent, or Firm*—George L. Williamson

[57] ABSTRACT

An apparatus and method for securely holding a trash or garbage bag is provided. Said device comprises a base support frame, a rectangular shaped frame, and rotatable connecting means for connecting the two. The method comprises inserting the frame into the open end of a trash bag and rotating the rectangular shaped frame so as to securely hold the trash bag.

3 Claims, 1 Drawing Sheet

METHOD AND APPARATUS FOR BAGGING TRASH

BACKGROUND OF THE INVENTION

The present invention relates to the field of trash, leaf and/or debris bagging, and specifically to the opening and holding open of any form of trash bag or like device. More particularly, the present invention provides a new and novel method and device for opening and holding open a trash bag so that trash, leaves and/or other debris can be swept, raked, or placed in the bag in an easy and convenient manner so that one's hands are free.

Trash bagging systems have been described in the prior art. U.S. Pat. Nos. 3,934,803 and 4,023,842, described a spring action bag opener. U.S. Pat. Nos. 2,412,834; 3,695,565; 4,440,430; and 4,006,928, described a bag opener designed to stretch the bag over the frame.

As will be shown by way of explanation and drawings, the present invention works in a novel manner and differently from the prior inventions.

SUMMARY OF INVENTION

The present invention describes a method and device for opening and holding open a commercially available trash or garbage bag so that trash, leaves, and/or debris can be placed therein.

The present invention is comprised of a rectangular shaped frame and a support base frame that are rotatably attached together at two pivot points. The base frame encompasses two horizontal stabilizer legs, two vertical legs and a horizontal cross member. The rectangular shaped frame encompasses two side bars, one top bar, one bottom bar, and one clip for connecting or latching the frame to the base.

The present invention is designed to be inserted into a bag with the rectangular shaped frame approximately parallel to the horizontal stabilizing legs of the base frame. The rectangular shaped frame is then rotated to a position where the clip on this frame attaches or latches to the bottom cross member of the support base frame. In this position, pressure will be applied to the inside perimeter or surface of the bag thus holding the bag in an open position.

The trash bagging apparatus, with the rectangular shaped frame in position approximately parallel to the two horizontal stabilizer legs, can be easily inserted into a bag, and when in its latched position, rests on the base and can then be placed on the ground, floor, or wall for easily raking, sweeping, or placing trash in the bag.

Prior art devices and/or systems of trash bagging consist essentially of placing bags inside containers, stretching bags over a frame, or of a spring action device that expands inside a bag. The spring action method is both awkward to install and very difficult to provide a desired pressure to firmly hold the bag without tearing it. Stretching a bag over a frame usually results in a loose configuration that does not provide sufficient holding power for raking or sweeping trash into the bag.

No clips or fasteners are needed to hold the bag on the frame of the present invention. The rotating or pivoting rectangular frame uses a mechanical advantage, similar to the action of a lever to apply sufficient pressure to capture a bag with maximum pressure and no tearing effect.

A clip or latch provided on the rectangular frame attaches or latches to the bottom cross member of the base support frame in order to lock the device in a position so that the mouth of the trash bag is open.

The present invention holds a trash bag very securely. This is achieved by properly designing the location of the pivot point on the vertical or riser bars with respect to the horizontal stabilizer legs so as to locate the height of the pivot point in proper relation to the stabilizing legs. Since the location of the vertical bars on the stabilizer legs is more or less off-set or cantilevered, its effect is to provide a proper angle of the bag opening in relation to the stabilizer legs so as to provide a free standing device.

Therefore, an objective of the present invention is to provide a means of raking, sweeping, or placing trash or other materials into a bag where the user has both hands free so that the user can then more conveniently rake or otherwise place trash or other material in the mouth or opening of the trash bag.

DESCRIPTION OF THE PREFERRED EMBODIMENTS

Figure 1:
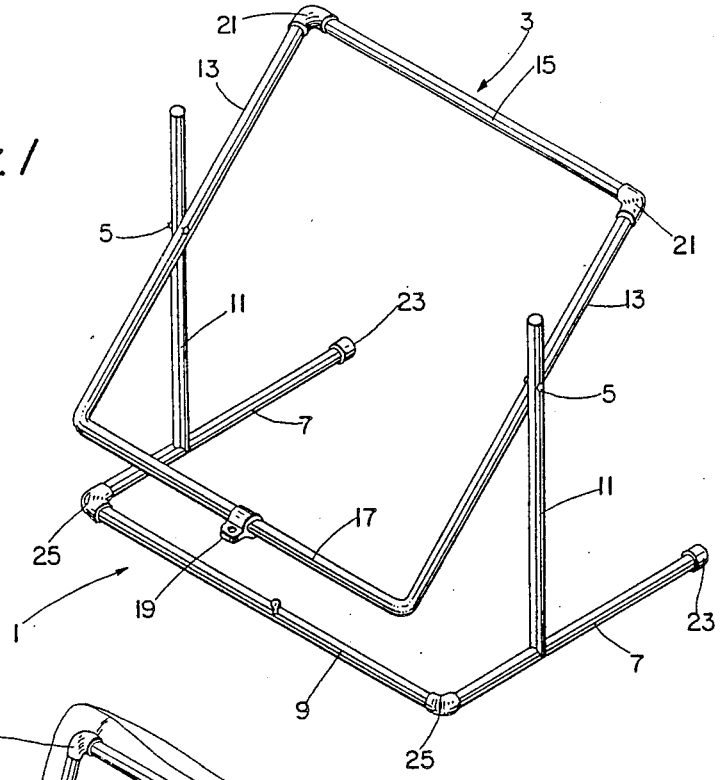
FIG. 1 is one perspective view of the frame members of the trash bagging device.

Turning now to FIG. 1, there is shown a drawing of the frame members of a fully assembled trash bagging device according to the present invention.

Therein is shown a framed assembly generally consisting of two parts: (1) a horizontal base frame support member is generally shown at 1; and (2) a rectangular shaped frame member is generally shown at 3. Rotatable connecting means between the two are generally shown at 5. Note that the base frame support is generally placed on the ground and the rectangular shaped framed member is pivoted or rotated so as to securely hold a trash bag. The base frame support, 1, consists of two horizontal stabilizing legs, 7, a cross bar member connecting the two stabilizing legs, 9, and two vertical riser legs providing at least two contact points for securely holding a garbage bag or like device or frame members, 11, each having one end connected to the same surface of the horizontal base frame support member. The rectangular shaped frame member, 3, consists of two side bar members, 13, a top bar member, 15, providing at least two contact points for securely holding a garbage bag or like device a bottom bar member, 17, having thereon a clip or latch, 19, for securely attaching the bottom bar member, 17, to the cross bar member, 9, which connects the two stabilizing legs. Note that enlarged corner joints may be provided at 21 on both ends of the top bar member and, furthermore, enlarged corner joints may be provided at 23 on the ends of the horizontal base frame support member, 7, and at the corners, 25, joining the cross bar member 9, and the stabilizer legs, 7.

Figure 2:
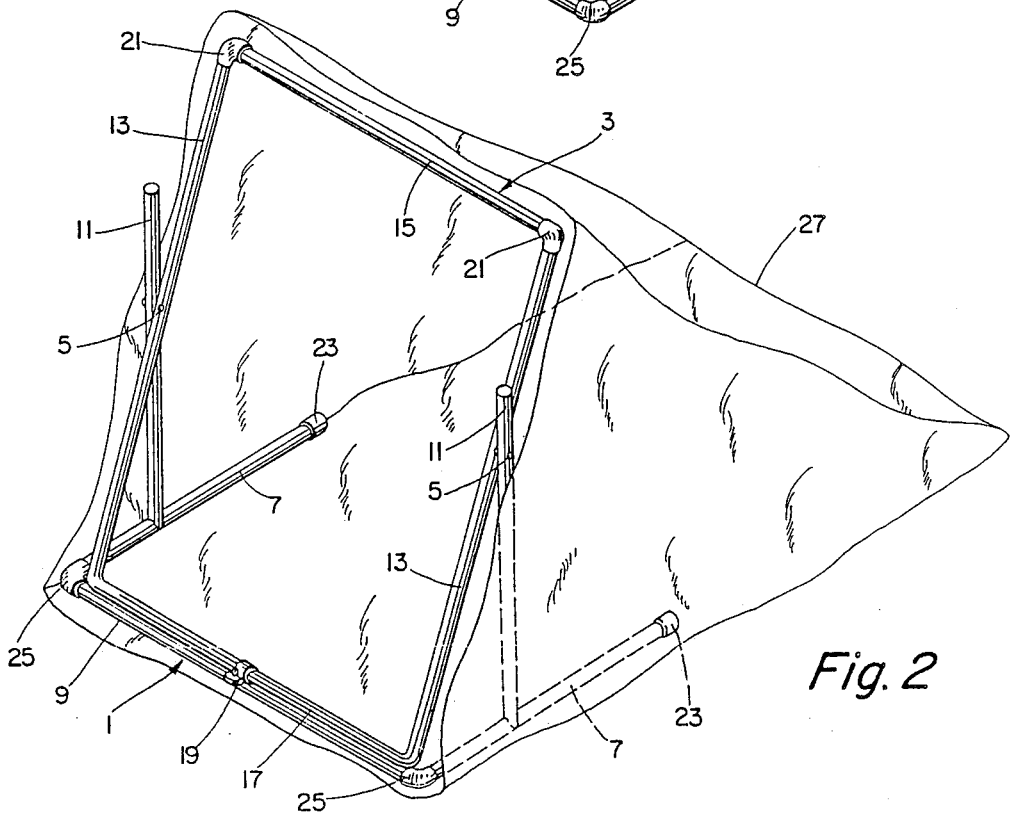
FIG. 2 is one perspective view of the present invention shown in operative connection with a trash bag.

FIG. 2 is a perspective of the present invention shown in operative connection with a trash bag connected thereto. The two stabilizing legs of the base frame are shown at 7, the two side bars of the rotable frame member are shown at 13, the top bar of the rotable member of the frame is shown at 15, the cross member of the stabilizing base assembly is shown at 9, the bottom bar of the rotable frame member is shown at 17, the pivoting means are shown at 5, the vertical legs of the stabilizing base assembly are shown at 11, the clip or latch, 19, is shown being attached to the cross member 9, and while not shown raised or enlarged corners could have been shown at 21, 23, and 25. Furthermore, a garbage bag, 27, is shown being supported by the present invention.

This present invention is operated by rotating the rectangular shaped member of the frame. This is accomplished by placing the frame inside the mouth of the bag with the stabilizing legs, 7, pointed to the closed end of the bag and with the side bars, 13, in a position parallel with relation to the stabilizing legs, 7. The lip of the bag is then placed over the top bar, 15, and the bottom cross member, 9, with the edge of the bag being extended one to one and one-half inch over each. The bottom bar, 17, is then rotated toward the bottom cross member, 9, on the pivots, 5, on each vertical riser leg, 11. As the bottom bar, 17, is rotated toward the cross member, 9, the top bar, 15, engages the inside surface of the bag as the distance between the enlarged corner joints of the top bar member, 21, and the enlarged corner joints of the horizontal stabilizing legs, 25, becomes greater, the bag becomes tightly held to the frame. It should be obvious that the horizontal base frame support member at, 25, and the rectangular shaped frame member at 21, each provide at least two contact points for securely holding a garbage bag or like device. There is a mechanical advantage provided by rotating the top bar member, 15, and therefore the bag can be held and/or stretched extremely tightly. When the bottom bar, 17, reaches the bottom cross member, 9, the clip, 19, locks onto the bottom cross member, 9, and thus locks the bagger in a position so that the mouth of the trash bag is open. Superior holding power is provided by the enlarged corners, 21, on the rectangular frame, and the enlarged corner joints, 23 and 25, on the stabilizer legs. Furthermore, the enlarged joints provide a large gripping surface between the frame and the bag and they also reduce the chance of puncturing the bag.

To remove the bagger from the bag, the clip, 19, is pulled loose and the rotation of the rectangular frame member reversed causing the bag to loosen. The bag can then be easily removed from the device.

As can be seen, this invention has the following advantages over prior inventions:

1. It is not necessary to hold the legs in a retracted position while sliding the bag over the frame.
2. It is not necessary to stretch the bag over the frame.
3. There is no need for clips to hold the bag onto the frame.
4. A cantilevered effect is provided by the angle between the rectangular shaped frame and the stabilizer legs and this provides a free standing device.

The proper bag size for use with the present invention can be chosen in the following manner: (1) a bag large enough for the device to fit into it's mouth or open end while the horizontal base frame support member and the rectangular shaped frame member are parallel to each other is necessary; (2) a bag should be sized so that the bag is tightly contacted and secured by the four contact points of the present invention; and (3) the bag must be large enough so that it does not tear when the frame is rotated into its clamped position.

From the foregoing teachings, it is clear that the invention can be economically manufactured of various materials so as to provide a convenient and easily usable improved leaf bagger. Furthermore, the foregoing teachings show that the invention can be manufactured of many types of material including metals, plastics or like materials.

The teachings of this specification are meant to be illustrative and explanatory thereof and various changes in the size, and shape and material as well as in the illustrative construction of the preferred embodiments can be made without departing from the spirit of the present invention. Many other embodiments of the invention could be easily manufactured by simply modifying the invention as herein and above described and shown in the attached drawings and following claims.

We claim:

1. A device for securely holding a trash bag comprising:

(a) a horizontal base frame support member having at least two contact points for securely holding the bag;
(b) two vertical frame members each having one end connected to said horizontal base frame support member;
(c) a rectangular shaped frame member having at least two contact points for securely holding the bag;
(d) means being provided for rotably connecting opposite faces of said rectangular shaped frame member to each of said two vertical frame members; and
(e) means being provided for securely latching said rectangular shaped frame member to said horizontal base frame support member.

2. A device for securely holding a trash bag comprising:

(a) a horizontal base frame support member having at least two contact points for securely holding the bag;
(b) said horizontal base frame support member having two stabilizer legs;
(c) said stabilizer legs each being connected at one end to a cross bar member;
(d) two vertical frame members each having one end connected to said horizontal base frame support member;
(e) a rectangular shaped frame member having at least two contact points for securely holding the bag;
(f) said rectangular shaped frame member having two side bars, a top bar, and a bottom bar;
(g) means being provided for rotatably connecting opposite faces of said side bars of said rectangular shaped frame member to each of said two vertical frame members; and
(h) means being provided for securely latching said bottom bar of said rectangular shaped frame member to said cross bar member of said horizontal base frame support.

3. A method for securely holding a trash bag composing the following steps:

(a) providing a horizontal base frame member having at least two contact points for securely holding the bag;
(b) providing two vertical frame members each having one end connected to said horizontal base frame member;
(c) providing a rectangular shaped frame member having at least two contact points for securely holding the bag;

(d) rotatably connecting said rectangular shaped frame member to said two vertical frame members whereby said rectangular shaped frame member can lie in either a plane parallel to or nearly perpendicular to said horizontal base frame member;

(e) placing a trash bag in connection with said horizontal base frame member and rectangular shaped frame member while said rectangular shaped frame member is lying in a plane parallel to said horizontal base frame member;

(f) thereafter rotating said rectangular shaped frame member into a plane nearly perpendicular to the plane of said horizontal base frame member whereby the bag is securely held by said rectangular shaped frame member and said horizontal base frame member; and (g) latching said rectangular shaped frame to said horizontal base frame member.

* * * * *

UNITED STATES PATENT AND TRADEMARK OFFICE

CERTIFICATE OF CORRECTION

PATENT NO. : 4,981,274

DATED : Jan. 1, 1991

INVENTOR(S) : Roger S. McVay, et al.

It is certified that error appears in the above-identified patent and that said Letters Patent is hereby corrected as shown below:

On the title page, item [75] Inventors, change "W.E. Brooklyn" to --W.E. Brooks, Jr.--.

Signed and Sealed this

Eleventh Day of January, 1994

Bruce Lehman

*Attest:*

BRUCE LEHMAN

*Attesting Officer*

*Commissioner of Patents and Trademarks*